US007504783B2

(12) United States Patent
Zarr

(10) Patent No.: US 7,504,783 B2
(45) Date of Patent: Mar. 17, 2009

(54) CIRCUIT FOR DRIVING AND MONITORING AN LED

(75) Inventor: Richard F. Zarr, Sanford, FL (US)

(73) Assignee: National Semiconductor Corporation, Santa Clara, CA (US)

( * ) Notice: Subject to any disclaimer, the term of this patent is extended or adjusted under 35 U.S.C. 154(b) by 8 days.

(21) Appl. No.: 11/728,148

(22) Filed: Mar. 23, 2007

(65) Prior Publication Data

US 2008/0231198 A1 Sep. 25, 2008

(51) Int. Cl.
*H05B 37/02* (2006.01)

(52) U.S. Cl. ..... 315/307; 315/308; 315/224

(58) Field of Classification Search ..... 315/224, 315/247, 291, 307, 119, 185 S, 308; 345/82, 345/102, 204

See application file for complete search history.

(56) References Cited

U.S. PATENT DOCUMENTS 6,111,739 A 8/2000 Wu et al.
6,909,249 B2 * 6/2005 Otake ..... 315/291
7,005,914 B2 2/2006 Balakrishnan et al.
7,259,526 B2 * 8/2007 Hung et al. ..... 315/291
7,312,783 B2 * 12/2007 Oyama ..... 345/102
2006/0119291 A1 * 6/2006 Hung et al. ..... 315/291
2006/0197469 A1 * 9/2006 Kim ..... 315/291
2007/0114951 A1 * 5/2007 Tsen et al. ..... 315/291

FOREIGN PATENT DOCUMENTS

KR 1020030002175 A 1/2003

* cited by examiner

*Primary Examiner*—David Hung Vu
*Assistant Examiner*—Tung X Le

(57) ABSTRACT

Described herein is technology for, among other things, a circuit for controlling a current through an LED. The novel circuit includes a regulator for providing the current to the LED, an LED voltage monitoring circuit for monitoring a voltage drop across the LED and for providing a voltage reading signal based on the voltage drop. The novel circuit further includes a data converter logic circuit coupled with the regulator and the LED voltage monitoring circuit. The data converter logic circuit is operable to control the regulator to adjust the current based on the signal.

8 Claims, 5 Drawing Sheets

400

CIRCUIT FOR DRIVING AND MONITORING AN LED

BACKGROUND

FIELD

Embodiments generally relate to circuits for monitoring and driving one or more light emitting diodes.

BACKGROUND

The ratio of light emitted versus the amount of power consumed (also known as efficacy) for early light emitting diodes (LEDs) was relatively poor. Recent advances in LED technology have dramatically increased LED efficacy. For example, some present-day LEDs exceed 100 lumens per watt. In contrast, a conventional incandescent light bulb only produces roughly 17 lumens per watt. In addition to improved efficacy, LEDs also offer greater durability, improved light focusing, and longer life span than incandescent bulbs. Clearly, LEDs are becoming an extremely viable lighting alternative.

One drawback to using LEDs is that, in contrast to incandescent bulbs, which radiate most of their waste heat in the infrared, LEDs do not radiate outside of their emission spectrum. Instead, waste heat must be conducted away through thermal transmission. In other words, LEDs generally require heat sinks to carry the heat away. Excess heat that is not handled properly can cause a shift in the spectral emission of an LED and also lead to premature failure of the LED. For example, some LEDs when detached from their heat sinks will incinerate themselves within a few seconds. Thus, heat management for LEDs is critical. In some cases, simply adding a heat sink to an LED is not sufficient. For example, it is possible that a heat sink may become detached from an LED during operation, causing the LED to overheat and eventually burn out.

Conventional LED lighting applications typically use a driver integrated circuit to power an externally coupled LED. One such circuit is the LM3402/LM3402HV, "0.5A Constant Current Buck Regulator for Driving High Power LEDs," manufactured by National Semiconductor Corporation. Such conventional driver circuits do not monitor the temperature of an attached LED. Instead, additional external circuitry is required to measure the temperature of the LED. This external circuit may involve, for example, attaching a temperature sensitive element (e.g., thermister, thermocouple, etc.) to the LED itself or, more likely, the heat sink. Because the temperature sensing circuitry is external to the driver IC, it has limited control over the amount of current through the LED. For example, while such circuitry may be able to cut off power to the driver circuit altogether, it is not able to incrementally reduce the current through the LED. This lack of control is unacceptable, for example, in emergency situations where a diminished level of output is desired over no output at all.

In addition to simply overheating, LEDs are susceptible to current runaway. This is due to the fact that as an LED increases in temperature, electrons are allowed to move more freely through it. This results in increased current through the LED, which in turn generates even more heat, and so on. Some conventional circuits monitor the current through an LED and, through feedback, operate to prevent current runaway. For example, in one conventional implementation, a small sense resistor is externally coupled in series with the LED. The voltage across the resistor is measured and thereby used to indirectly determine the current through the LED. While such circuitry may prevent current runaway by cutting back the current, it cannot specifically detect a short-circuit of the LED. Moreover, this circuitry cannot intelligently determine why a reduction in current is necessary. For example, the circuitry cannot detect that a heat sink has become detached, causing an increase in temperature and current of the LED.

Thus, conventional technology does not provide an effective solution for monitoring the temperature of an LED and controlling the current though the LED based on the temperature. Additionally, conventional technology does not allow for detection of a short-circuit or open-circuit through an LED or one or more strings of LEDs.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

Described herein is technology for, among other things, a circuit for controlling a current through an LED. The novel circuit includes a regulator for providing the current to the LED, an LED voltage monitoring circuit for monitoring a voltage drop across the LED and for providing a voltage reading signal based on the voltage drop. The novel circuit further includes a data converter logic circuit coupled with the regulator and the LED voltage monitoring circuit. The data converter logic circuit is operable to control the regulator to adjust the current based on the signal.

Thus, embodiments provide for a mechanism for monitoring the temperature of an LED that may be included within an LED driver integrated circuit. This is very advantageous because it allows for the gradual adjustment of the current through the LED so as to maintain a reduced mode of operation, rather than cutting off current to the LED altogether. This is highly important in applications such as emergency lighting, where having at least some light is greatly preferred to having no light at all. Moreover, the technology described herein allows for the detection of failure conditions of one or more LEDs. For example, embodiments are operable to detect short circuits and open circuits with respect to the LEDs.

Moreover, measuring the temperature of an LED directly, as is done in embodiments of the present invention, is preferable to measuring the temperature indirectly, such as by measuring the temperature of a heat sink attached to an LED. For instance, it is conceivable that a heat sink may become detached from the LED, in which case the heat sink would begin to cool off while the LED itself rapidly heats up. A heat sink-attached solution may not be able to detect this condition, or it may detect it too late. On the other hand, a direct measurement of the temperature of the LED will provide immediate feedback because such circuitry will detect an immediate and sudden rise in LED temperature.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Overview

Generally speaking, embodiments provide technology for controlling the current through a light emitting diode (LED) in response to changes in a voltage across the LED. Embodiments are able to gradually adjust the current of the LED, rather than simply shutting off the LED. As such, embodiments allow for an overheating LED to operate in a diminished mode while at the same time preventing complete failure of the LED.

It is appreciated that a relationship exists between an operating point of an LED and the temperature of the LED. Thus, in one embodiment, the voltage across the LED is correlated to an approximate temperature of the LED. In another embodiment, multiple operating points of the LED are sampled to improve temperature accuracy.

Exemplary Circuits, in Accordance with Various Embodiments

Figure 1:
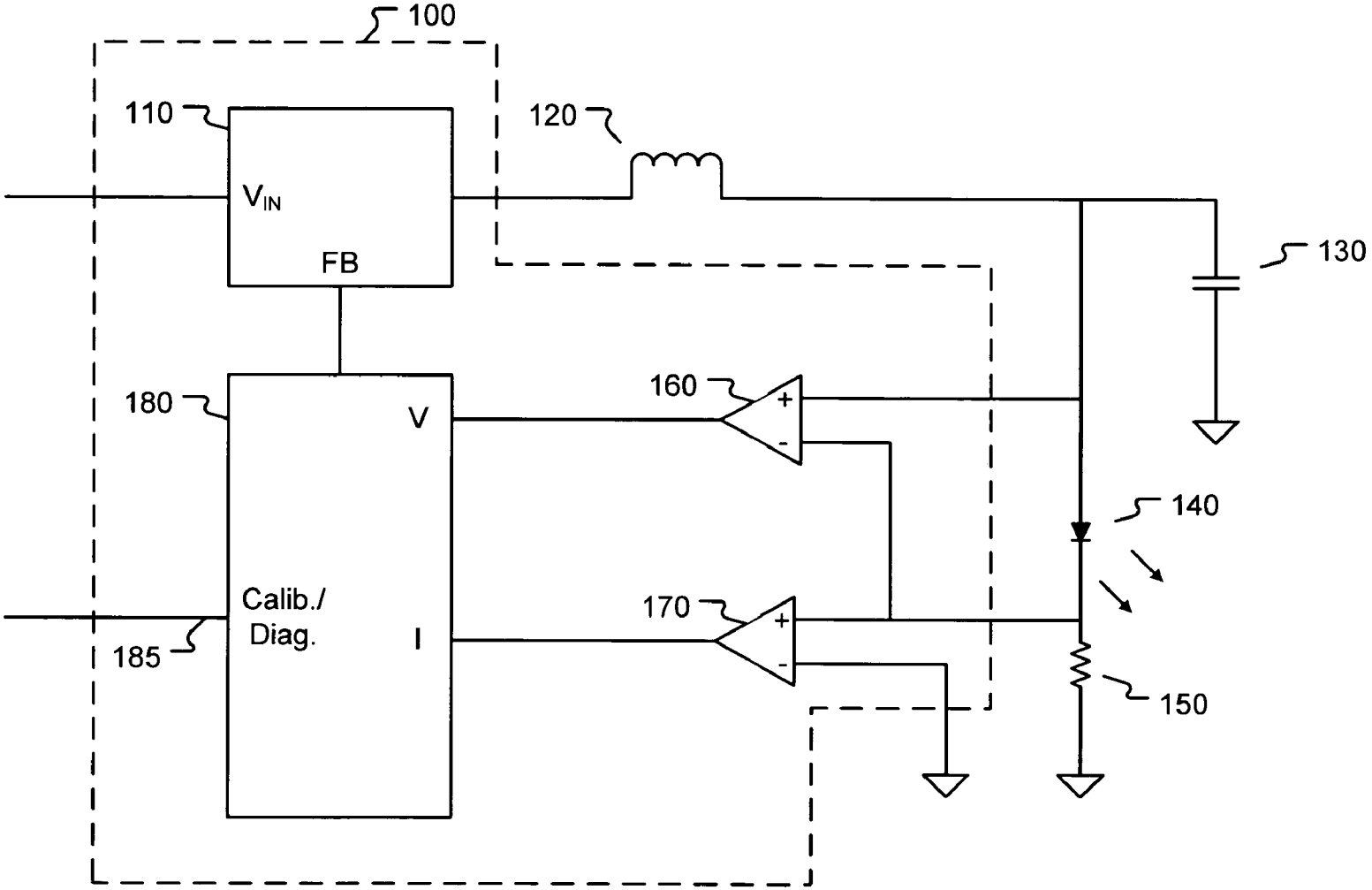
FIG. 1 illustrates a diagram of a circuit for controlling an LED, in accordance with various embodiments of the present invention.

FIG. 1 illustrates a diagram of a circuit 100 for controlling an LED 140, in accordance with various embodiments of the present invention. It should be understood that embodiments are not limited to a single LED. For example, multiple LEDs may be used in series, parallel, or any combination thereof. In one embodiment, circuit 100 is contained within a single integrated circuit chip. Thus, LED 140, as well as inductor 120, capacitor 130, and resistor 150, may be externally coupled with circuit 100. It should be appreciated that other combinations of inductors, capacitors, and resistors may be used without departing from the spirit of embodiments of the present invention. LED 140 may be one or more high power LEDs suitable for use as a light source.

Circuit 100 includes a regulator 110 for supplying a current to the LED 140. The regulator 110 may also be referred to as a driver circuit. In one embodiment, the regulator 110 may be a PWM regulator. During operation, current generated by the regulator 110 passes through the LED and then subsequently passes through the resistor 150.

Circuit 100 also includes a voltage monitoring circuit 160 for monitoring a voltage drop across the LED 140. In one embodiment, the voltage monitoring circuit 160 may be an error amplifier. Assuming a constant current I through the LED 140, changes in the temperature of the LED 140 are reflected as changes in a voltage drop V across the LED 140. Thus, the voltage monitoring circuit 160 enables circuit 100 to monitor the temperature of the LED 140.

Circuit 100 also includes a data converter logic circuit 180, which is operable to control the regulator 110 to adjust the current through the LED 140. The data converter logic circuit 180 may include a number of components, including, but not limited to, analog-to-digital converters (ADC), digital-to-analog converters (DAC), logic controllers, and the like. The data converter logic circuit 180 is coupled with an output of the voltage monitoring circuit 160. In other words, the data converter logic circuit 180 may receive a signal from the voltage monitoring circuit 160 which represents the voltage drop across the LED 140. Based on this signal, the data converter logic circuit 180 may then control the regulator 110 to adjust the current through the LED 140. For example, during operation, the LED 140 may suddenly begin to increase in temperature. This will cause a corresponding increase in voltage across the LED 140, which will be detected by the voltage monitoring circuit 160. In response, the data converter logic circuit 180 may cause the regulator 110 to decrease the current through the LED 140. It should be appreciated that such increases or reductions in the current through the LED 140 may be gradual. In other words, circuit 100 is not limited to "all-or-nothing" operation. Thus, as illustrated in the above example, the circuit 100 is capable of running the LED 140 in a reduced performance mode to conserve the LED 140, rather than simply shutting it off altogether.

Circuit 100 may also include a current monitoring circuit 170 for monitoring the current through the LED 140. In one embodiment, the current monitoring circuit 170 may be an error amplifier similar to that of the voltage monitoring circuit 160. The current monitoring circuit 170 may measure the current through the LED 140, for example, by measuring the voltage drop across the resistor 150.

Similar to the voltage monitoring circuit 160, the current monitoring circuit 170 may provide a signal to the data converter logic circuit 180 that represents the current through the LED 140. The data converter logic circuit 180 may use this information, for example, to prevent runaway of the LED 140. Additionally, based on the outputs of the voltage monitoring circuit 160 and the current monitoring circuit 170, the data converter logic circuit 180 is operable to determine a current operating point of the LED 140. Based on the operating point, the data converter logic circuit 180 may then approximate the temperature of the LED 140. Consequently, the data converter logic circuit 180 may use this combined data in determining what adjustments, if any, need to be made to the current through the LED.

In addition to detecting temperature changes of the LED 140, circuit 100 is also operable to detect various other failure conditions of the LED 140. For example, in one embodiment, the data converter logic circuit 180 is operable to detect an open circuit or a short-circuit of the LED 140. Such detection is possible even in the case where one out of a plurality of LEDs 140 experiences such a failure. In the case of a single LED, an open circuit (which is a common failure mode) is detected when a sudden drop is detected in the current or a sudden voltage rise is detected across the LED. In the case of a single LED that becomes shorted, a sudden drop in the voltage across the LED can be detected. In the cases where there are several LEDs in series, the open circuit condition will affect all the LEDs and is the same as the single LED and a single short will suddenly reduce the voltage drop across the entire string of LEDs. In the cases where there are several LEDs in parallel, the short circuit condition is the same as the single LED because most or all current will be shorted through the failed LED, and a single open LED will suddenly increase the voltage drop across the parallel LEDs.

The data converter logic circuit 180 may include one or more calibration and/or diagnostic inputs/outputs, hereinafter referred to as interface 185. Interface 185 may be used to calibrate circuit 100 to a particular LED 140. Additionally, interface 185 may be used to provide various types of diagnostic information. The diagnostic information may include, but is not limited to, a serial data stream, an approximate temperature of the LED 140, the current through the LED 140, the voltage drop across the LED 140, and a failure condition of the LED 140.

Figure 2:
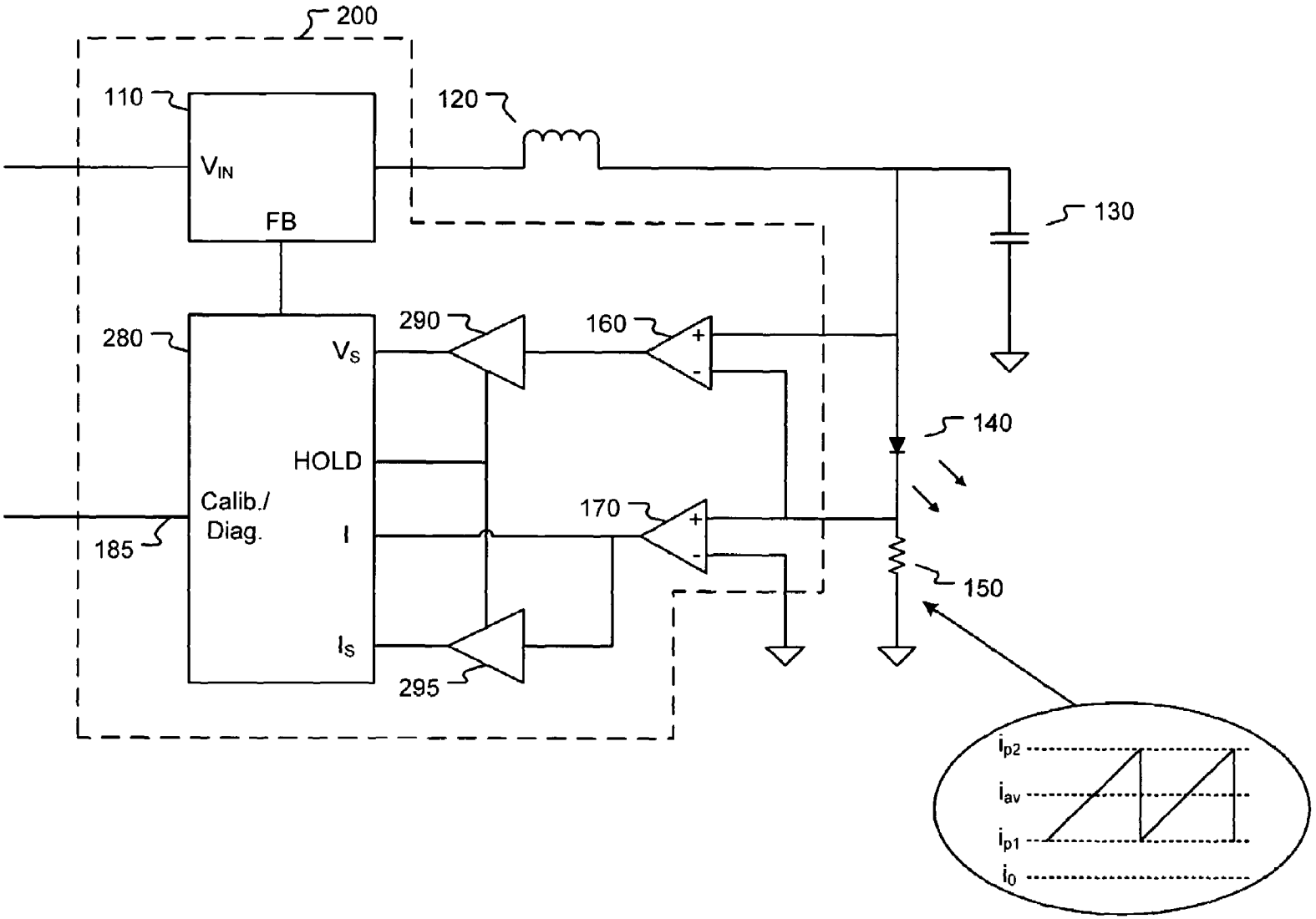
FIG. 2 illustrates another circuit for controlling an LED, in accordance with various embodiments of the present invention.

FIG. 2 illustrates another circuit 200 for controlling an LED 140, in accordance with various embodiments of the present invention. Circuit 200 provides enhanced accuracy over circuit 100. Circuit 200 includes the regulator 110, the voltage monitoring circuit 160, and the current monitoring circuit 170. Circuit 200 also includes a data converter logic circuit 280, which is operable to control the regulator 110 to adjust the current through the LED 140. The data converter logic circuit 280 is further operable to control the regulator 110 to output a variable current that varies between a first value ($i_{p2}$) and a second value ($i_{p1}$). The visual output of the LED 140 reflects an average (DC) value of $i_{av}$. The current waveform may be a sawtooth waveform, as shown. However, it should be appreciated that embodiments are not limited as such.

Circuit 200 also includes sample and hold circuits 290 and 295. Sample and hold circuit 290 is coupled between the voltage monitoring circuit 160 and the data converter logic circuit 280 and is operable to sample and hold a, value ($V_S$) of the output of the voltage monitoring circuit 160. Sample and hold circuit 295 is coupled between the current monitoring circuit 170 and the data converter logic circuit 280 and is operable to sample and hold a value ($I_S$) of the output of the current monitoring circuit 170. Thus, as the current through the LED 140 varies, the sample and hold circuits 290 and 295 enable the data converter logic circuit 280 to synchronize the collection of multiple data points from the LED 140. With this capability, the data converter logic circuit 280 is able to determine the temperature based on two data points: ($V_1$, $I_1$) and ($V_2$, $I_2$). Using multiple data points, the temperature can be determined based on a ratio of deltas (i.e., $\partial V/\partial I$) which accounts for offsets and other variations from circuit to circuit and LED to LED. In other words, calculating temperature based on deltas reduces the need for calibration. The processes and equations for determining the temperature of a diode junction based on multiple data points is known in the art and need not be discussed at length here.

In one embodiment, the sample and hold circuits 290 and 295 are controlled by a hold signal generated by the data converter logic circuit 280. The data converter logic circuit 280 may assert the hold signal when the current through the LED 140 crosses a threshold value. For example, the data converter logic circuit 280 may assert the hold signal when the current goes above the upper 10% of its variation or below the lower 10% of its variation. This determination may be achieved, for example, by directly coupling the current monitoring circuit 170 with the data converter logic circuit 280. Internally, the data converter logic circuit 280 may have one or more comparators (not shown) coupled to the output of the current monitoring circuit and set to these thresholds.

Figure 3:
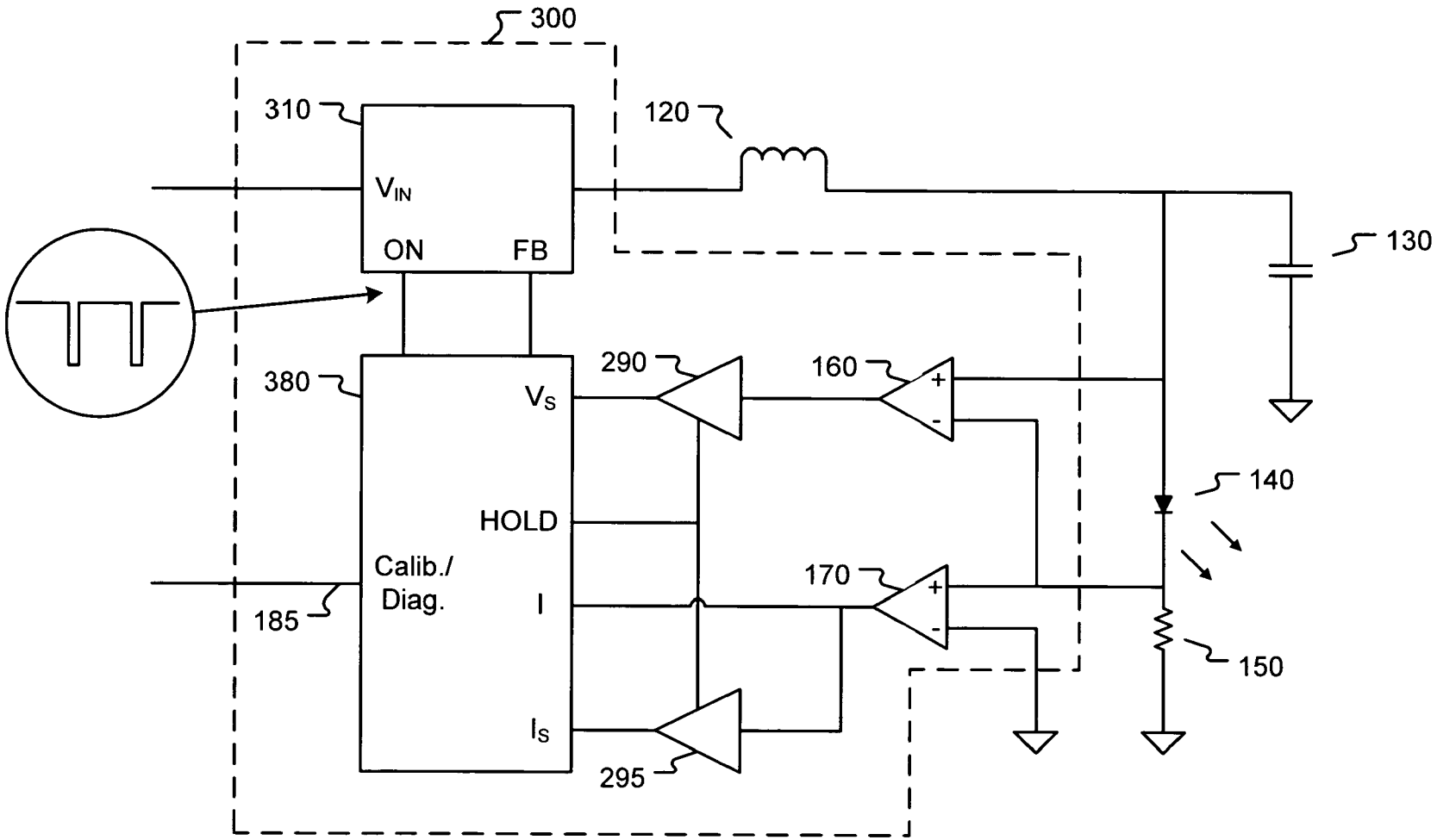
FIG. 3 illustrates another circuit for controlling an LED, in accordance with various embodiments of the present invention.

FIG. 3 illustrates another circuit 300 for controlling an LED 140, in accordance with various embodiments of the present invention. Similar to circuit 200, circuit 300 also varies the current through the LED 140. However, the implementation is slightly different. The circuit 300 includes a regulator 310 which, in addition to a feedback input(s) (FB), also has an input (ON) for allowing the data conversion logic circuit 382 toggle it on and off. During operation, the data converter logic circuit 380 periodically toggles the regulator 310 off and then on again. Consequently, the regulator 310 outputs current as a square wave or a PWM wave to the LED 140. Thus, the data converter logic circuit 380 would collect a data point during the blanking period of the LED 140 and again when the current is restored to the LED 140. The remaining operations of the data converter logic circuit 380, such as the determination of the temperature of the diode 140, generating diagnostic information, etc., may be substantially the same as the data converter logic circuit 280 of FIG. 2.

Exemplary Operations in Accordance with Various Embodiments

Figure 4:
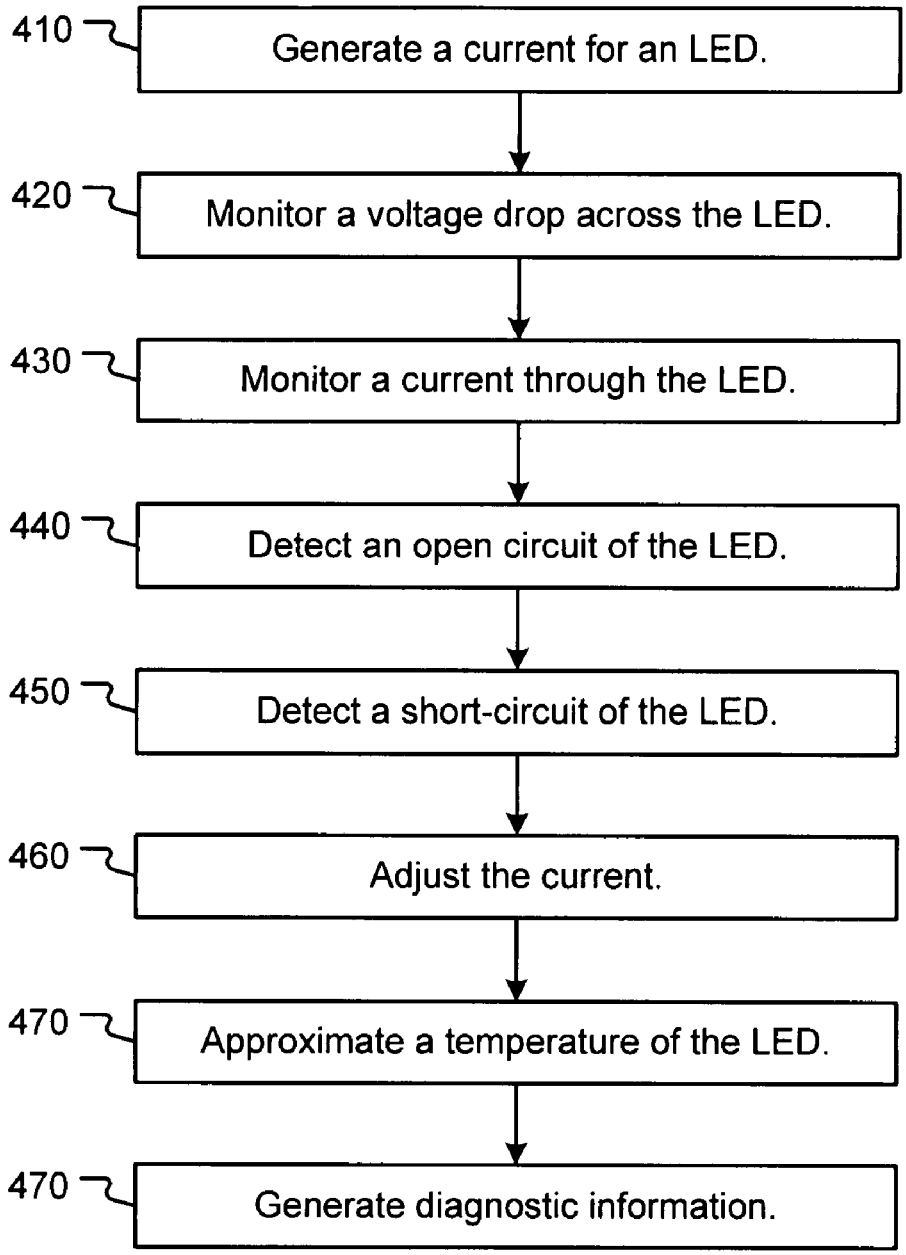
FIG. 4 illustrates a flowchart of a process for controlling an LED, in accordance with various embodiments of the present invention.
Figure 5:
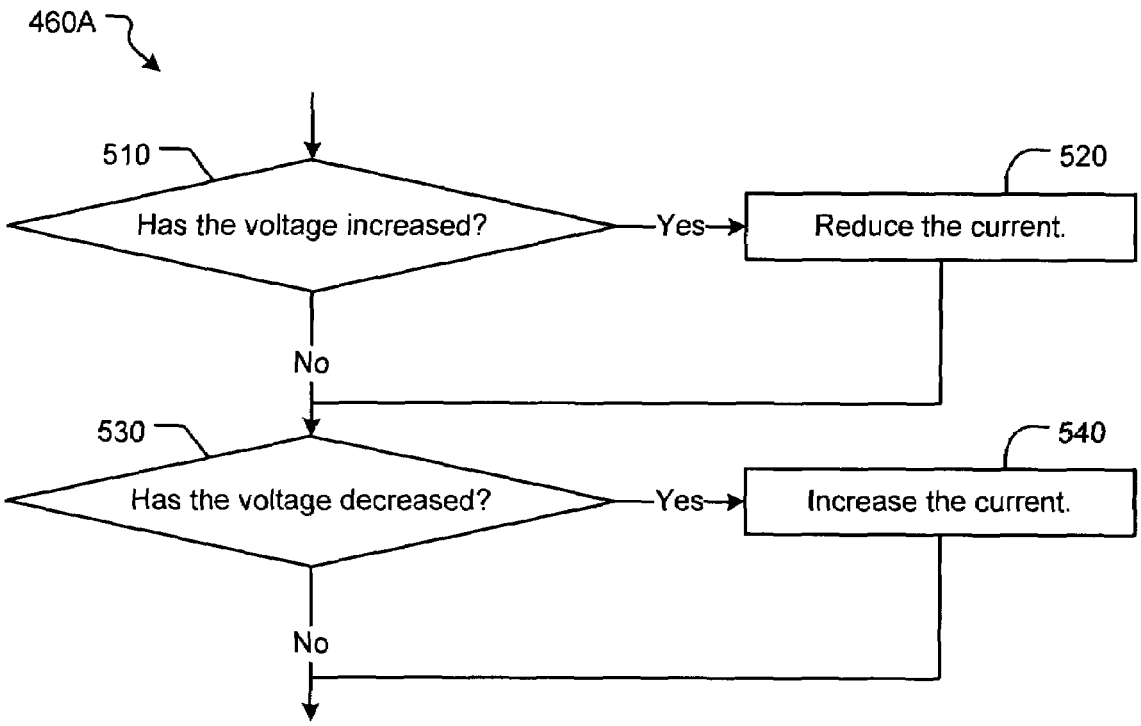
FIG. 5 illustrates a flowchart for a process of adjusting a current through an LED, in accordance with various embodiments of the present invention.
Figure 6:
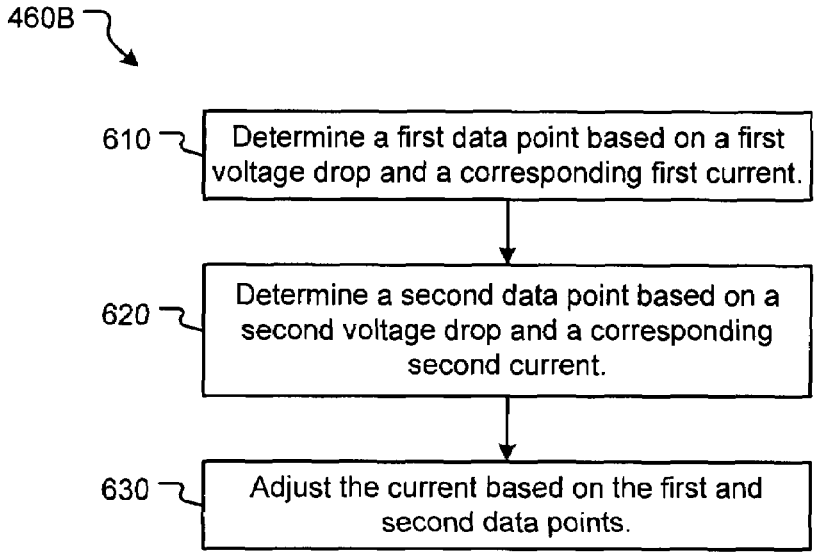
FIG. 6 illustrates a flowchart for another process of adjusting a current through an LED, in accordance with various embodiments of the present invention.

The following discussion sets forth in detail the operation of present technology for controlling an LED. With reference to FIGS. 4-6, flowcharts 400, 460A, and 460B each illustrate example operations used by various embodiments of the present technology for controlling an LED. Flowcharts 400, 460A, and 460B include processes that, in various embodiments, are carried out by circuitry in an integrated circuit. Although specific operations are disclosed in flowcharts 400, 460A, and 460B, such operations are examples. That is, embodiments are well suited to performing various other operations or variations of the operations recited in flowcharts 400, 460A, and 460B. It is appreciated that the operations in flowcharts 400, 460A, and 460B may be performed in an order different than presented, and that not all of the operations in flowcharts 400, 460A, and 460B may be performed.

FIG. 4 illustrates a flowchart 400 of a process for controlling an LED, in accordance with various embodiments of the present invention. While the following discussion may repeatedly refer to "an LED," it will be appreciated that multiple LED's may be used in series, in parallel, or in any combination thereof Block 410 involves generating a current for an LED. It should be appreciated that this may be achieved in a number of ways. For example, the current may be constant (i.e., DC) or variable. In the case of a variable current, the current may take on a number of forms, such as a sawtooth current, a square wave, etc.

At block 420, a voltage drop across the LED is monitored. This may involve, for example, periodically sampling the voltage across the LED, but is not limited as such. At block 430, a current through the LED is monitored. In one embodiment, this is achieved by monitoring the voltage across a resistor receiving the same current as the LED. Similar to block 420, monitoring the current may involve periodically sampling the current through the LED, but is not limited as such.

In one embodiment, flowchart 400 includes operations related to detecting failure conditions of the LED. For example, block 440 involves detecting an open circuit of the LED. In the case of a single LED, this may be achieved by detecting a sudden drop in the current or a sudden rise in voltage across the LED. In the cases where there are several LEDs in series, the open circuit condition will affect all the LEDs and is the same as the single LED. In the cases where there are several LEDs in parallel, an open circuit conditional will cause a sudden increase in the voltage across the LEDs. Block 450 involves detecting a short-circuit of the LED. In the case of a single LED that becomes shorted, a sudden drop in the voltage across the LED can be detected. In the cases where there are several LEDs in series, a single short will suddenly reduce the voltage drop across the entire string of LEDs. In the cases where there are several LEDs in parallel, a single short will suddenly reduce the voltage drop across the entire string of LEDs (to near-zero).

Block 460 involves adjusting the current through the LED. This adjustment may occur in response to changes in the voltage and/or current of the LED. It should be appreciated that this may be achieved in a number of ways. For example, FIG. 5 illustrates a flowchart 460A for a process of adjusting a current through an LED, in accordance with various embodiments of the present invention. Flowchart 460A may be implemented, for example, when a substantially DC current is generated for the LED. At block 510, a determination is made as to whether the voltage across the LED has increased. If yes, then the current through the LED is reduced (block 520). If no, a determination is made as to whether the voltage through the LED has decreased (block 530). If yes, then the current through the LED is increased (block 520).

FIG. 6 illustrates a flowchart 460B for another process of adjusting a current through an LED, in accordance with various embodiments of the present invention. Flowchart 460B may be implemented, for example, when the current generated for the LED is a variable current. At block 610, a first data point is determined based on a first voltage drop and a corresponding first current of the LED. At block 620, a second data point is determined based on a second voltage drop and a corresponding second current. Block 630 then involves adjusting the current through the LED based on the first and second data points. This adjustment may be based, for example, on deltas between the two data points.

With reference again to FIG. 4, Block 470 involves approximating a temperature of the LED. Determination of the temperature may be based on the voltage across the LED. The determination may also be based on multiple voltage-current data points collected from the LED.

Block 470 involves generating diagnostic information. The diagnostic information may be provided, for example, at an output of an integrated circuit. The diagnostic information may include, but is not limited to the serial data stream, and approximate temperature of the LED, the current through the LED, the voltage drop across the LED, and a failure condition of the LED.

Thus, embodiments provide for a mechanism for monitoring the temperature of an LED that may be included within an LED driver integrated circuit. This is very advantageous because it allows for the gradual adjustment of the current through the LED so as to maintain a reduced mode of operation, rather than cutting off current to the LED altogether. This is highly important in applications such as emergency lighting, where having at least some light is greatly preferred to having no light at all. Moreover, the technology described herein allows for the detection of failure conditions of one or more LEDs. For example, embodiments are operable to detect short circuits and open circuits with respect to the LEDs.

Moreover, measuring the temperature of an LED directly, as is done in embodiments of the present invention, is preferable to measuring the temperature indirectly, such as by measuring the temperature of a heat sink attached to an LED. For instance, it is conceivable that a heat sink may become detached from the LED, in which case the heatsink would begin to cool off while the LED itself rapidly heats up. A heatsink-attached solution may not be able to detect this condition, or it may detect it too late. On the other hand, a direct measurement of the temperature of the LED will provide immediate feedback because such circuitry will detect an immediate and sudden rise in LED temperature.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A circuit for controlling a current through an LED, comprising:

a regulator for providing said current to said LED;

an LED voltage monitoring circuit for monitoring a voltage drop across said LED and providing a voltage reading signal based on said voltage drop;

a data converter logic circuit coupled with said regulator and said LED voltage monitoring circuit, wherein said data converter logic circuit is operable to control said regulator to adjust said current based on said signal;

an LED current monitoring circuit for monitoring said current through said LED and providing a current reading signal based on said current;

a first sample-and-hold circuit coupled with said LED voltage monitoring circuit and said data converter logic circuit, said first sample-and-hold circuit for capturing and providing a first instantaneous value of said voltage reading signal; and a second sample-and-hold circuit coupled with said LED current monitoring circuit and said data converter logic circuit, said first sample-and-hold circuit for capturing and providing a second instantaneous value of said current reading signal, wherein said data converter logic circuit is coupled to receive said first and second captured instantaneous values and operable to control said regulator based thereon.

2. The circuit as recited in claim 1 wherein said LED voltage monitoring circuit comprises an error amplifier.

3. The circuit as recited in claim 1 wherein said data converter logic circuit is operable to cause said first and second sample-and-hold circuits to capture said first and second instantaneous values when said current crosses a threshold.

4. The circuit as recited in claim 1 wherein said LED current monitoring circuit comprises an error amplifier.

5. The circuit as recited in claim 1 wherein said data converter logic circuit is operable to control said regulator to adjust said current when said voltage drop crosses a threshold value.

6. An integrated circuit for controlling a current through an LED, comprising:

a driver circuit for providing said current to said LED;

an LED voltage monitoring circuit for monitoring a voltage drop across said LED and providing a voltage reading signal based on said voltage drop;

a logic circuit coupled with said driver circuit and said LED voltage monitoring circuit, wherein said logic circuit is operable to control said driver circuit to adjust said current based on said signal;

an LED current monitoring circuit for monitoring said current through said LED and providing a current reading signal based on said current;

a first sample-and-hold circuit coupled with said LED voltage monitoring circuit and said logic circuit, said first sample-and-hold circuit for capturing and providing a first instantaneous value of said voltage reading signal; and a second sample-and-hold circuit coupled with said LED current monitoring circuit and said logic circuit, said first sample-and-hold circuit for capturing and providing a second instantaneous value of said current reading signal, wherein said logic circuit is coupled to receive said first and second captured instantaneous values and operable to control said driver circuit based thereon.

7. The circuit as recited in claim 6 wherein said logic circuit is operable to control said driver circuit to decrease said current in response to an increase in said voltage drop, and wherein further said logic circuit is operable to control said driver circuit to increase said current in response to a decrease in said voltage drop.

8. The circuit as recited in claim 6 wherein said logic circuit is operable to detect a short-circuit of said LED based on a change of said voltage drop.

* * * * *